US006471383B1

(12) United States Patent
Oyama et al.

(10) Patent No.: US 6,471,383 B1
(45) Date of Patent: Oct. 29, 2002

(54) HEADLAMP FOR VEHICLE

(75) Inventors: Hiroo Oyama; Yoshifumi Kawaguchi; Go Adachi; Masahito Okamoto, all of Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/660,108

(22) Filed: Sep. 12, 2000

(30) Foreign Application Priority Data

Feb. 25, 2000 (JP) ..... 2000/049563
Aug. 10, 2000 (JP) ..... 2000/242551

(51) Int. Cl.[7] ..... F21V 7/00

(52) U.S. Cl. ..... 362/517; 362/518; 362/298; 362/299; 362/356

(58) Field of Search ..... 362/517, 518, 362/298, 299, 346

(56) References Cited

U.S. PATENT DOCUMENTS 4,928,214 A * 5/1990 Oyama ..... 362/61
5,055,981 A * 10/1991 Nino ..... 362/61
5,927,849 A * 7/1999 Cassarly et al. ..... 362/551

* cited by examiner

*Primary Examiner*—Thomas M. Sember
*Assistant Examiner*—Jacob Y. Choi
(74) *Attorney, Agent, or Firm*—Weingarten, Schurgin, Gagnebin & Lebovici LLP

(57) ABSTRACT

There is provided a headlamp for a vehicle, comprising a light source; a first reflector formed of a parabolic reflector and having a focal point at which the light source is positioned; a light guide passage to the backside of the first reflector; a second reflector formed of a parabolic reflector and provided outside thereof corresponding to the light guide passage of the first reflector; a third reflector provided in the vicinity of an optical axis of the first It reflector for converging and transmitting a light from the light source to the vicinity of the light guide passage; and a lens provided in front of the first and second reflectors. The headlamp for a vehicle has an improved luminous flux efficiency to the light source and also has a height of about 30 mm in vertical direction, which is an original design which has not conventionally been implemented.

34 Claims, 8 Drawing Sheets

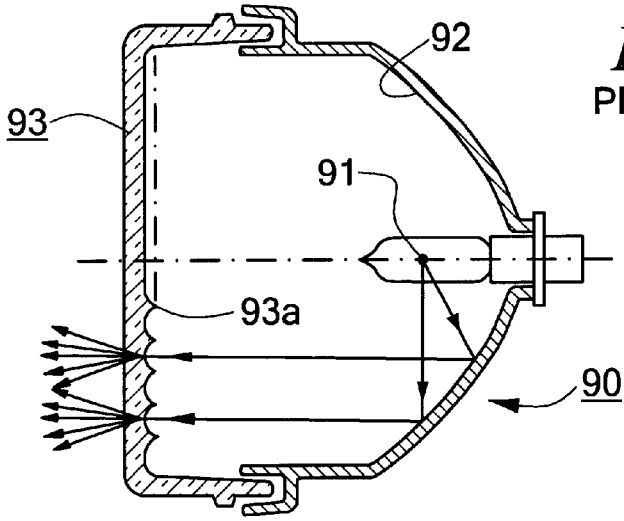
*FIG. 1*
PRIOR ART
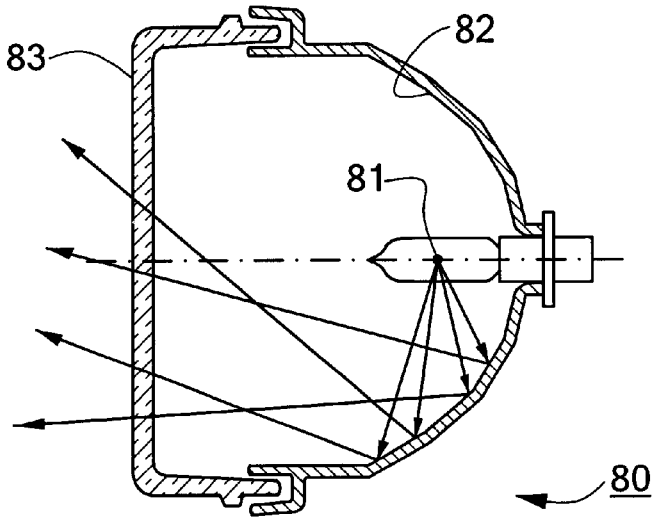
*FIG. 2*
PRIOR ART
*FIG. 3*
PRIOR ART
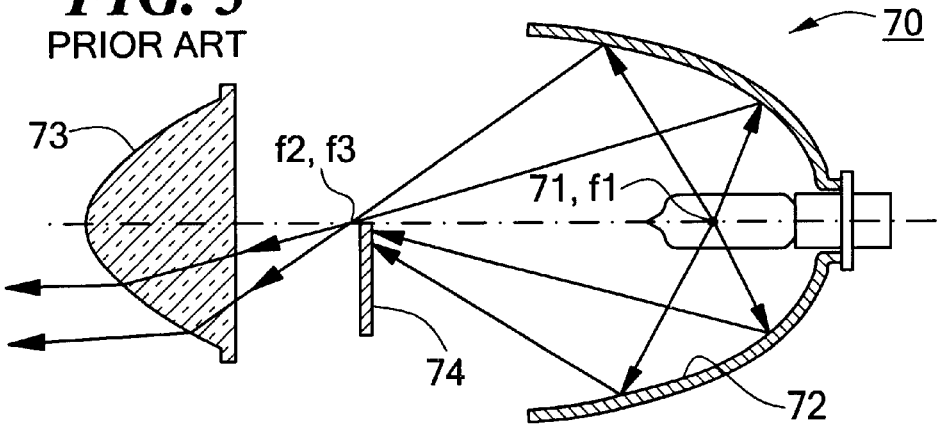

HEADLAMP FOR VEHICLE

BACKGROUND OF THE INVENTION

1. Field of the Invention

The present invention relates to headlamps for vehicles, and particularly relates to a headlamp for a vehicle, being capable of improving luminous flux efficiency to a light source and performance of the lamp, and also capable of providing an original design for appearance of the headlamp which has not been existed. Furthermore, the present invention relates to a headlamp for a vehicle, being capable of changing luminous intensity distribution properties for driving and for passing-by (or so-called "high-beam" and "low-beam") by utilizing a single light source.

2. Detailed Description of the Prior Art

FIGS. 1 to 3 show constructions of conventional a headlamp for a vehicle. Lamp 90 shown in FIG. 1 is composed of a light source 91, a revolved parabolic reflector 92 in which the light source 91 is positioned at its focal point, and a lens 93 having lens cuts 93*a* provided thereon. Light emitted from the light source 91 is reflected by the above mentioned revolved parabolic reflector 92 so as to become parallel with reference to the optical axis of the light source. The reflected light is diffused appropriately by the lens cuts 93*a* to obtain a required luminous intensity distribution property.

Moreover, lamp 80 shown in FIG. 2 is composed of a light source 81, a composite reflector 82, and a lens 83. The composite reflector 82 is composed of a plurality of parabolic columnar reflectors in which a parabola appears in a horizontal cross section when the lamp 80 is installed. Incidentally, the light source 81 is arranged at the focal point of the parabola. Further, the lens 83 is not provided with any lens cut formed thereon and is plain. In this lamp 80, a luminous intensity distribution property thereof can be adjusted by the above-mentioned composite reflector 82 itself. Furthermore, lamp 70 shown in FIG. 3 is composed of a light source 71, an elliptic type reflector 72, an aspheric lens 73, and a shade 74 if required. The elliptic type reflector 72 has a first focal point f1 where the light source 71 is positioned and is composed of elements such as revolved ellipsoidal reflector, composite ellipsoidal surface, ellipsoidal free curved surface or the like. In this case, the major axis of the elliptic type reflector 72 coincides with the illuminating direction and a light source image is generated by focusing it at the second focal point f2 thereof. Illuminating light can be obtained by enlarging and projecting the light source image by the aspheric lens 73. A desired luminous intensity distribution property can be obtained by shielding an unnecessary portion of light by means of the shade 74 (in the shown conventional example, the lower half of luminous flux converging at the second focal point f2 is shielded). Incidentally, the lamp system employing this type of elliptic type reflector 72 is called a projector type lamp.

However, out of the above-mentioned prior art lamps, for the lamp 90 shown in FIG. 1 the lens cuts 93*a* need to have a large optical power. As a result, the change in thickness of the lens 93 becomes large, which deteriorates transparency thereof. Accordingly, there are problems in that it is impossible to provide a suitable lamp appearance having transparency and a preferable depth to which consumers prefer in the market.

Furthermore, in the lamp 80 shown in FIG. 2, since the lens 83 is plain with no lens cut provided thereon, a suitable lamp appearance having a superior transparency can be obtained. However, it is difficult to ensure a luminous intensity distribution property in a width direction because the luminous intensity distribution property is formed by the composite reflector 82 positioned relatively deep. As a result, there is a problem in that formation of luminous intensity distribution property is limited.

Further, it is difficult to install the lamp 70 shown in FIG. 3 because of its depth. In addition, the illuminating area is small due to the small diameter of the employed aspheric lens 73. When the lamp 70 is employed as a headlamp, visibility thereof from opposed vehicles may be deteriorated.

In addition to the above-mentioned problems, since the lamps 90, 80, 70 having the above-mentioned prior art construction are widely employed, it is difficult to discriminate between these lamps and the other ones and also obtain an original design. Furthermore, each luminous flux efficiency of the lamps 90, 80, 70 having the above-mentioned prior art configurations is affected in response to the area of the reflector. Thus, when the lamp is reduced in its dimension (for example, making it thinner in width or both vertical and horizontal dimensions be made smaller) due to the demand in the market, the brightness thereof becomes significantly lower.

Besides, cross-sectional shape of luminous flux in the lamp 70 shown in FIG. 3 near the shade 74 is a semicircular shape (lower half of circle). When the luminous flux having such the shape is projected toward the illuminating direction by the projector lens 73 having a focal point f3 near the shade 74, the luminous flux is made inverted and emitted to have an upper half of circle shape toward the illuminating direction. Thus, a luminous intensity distribution shape suitable for passing-by can be obtained because the projected light does not contain any upward light which is the cause of dazzling light for opposed vehicles. However, in actual operation, in order to readily recognize walkers passing by or road signs, a shade 74 is modified to generate an appropriate light in the upper left-side direction for left-side traffic.

In this lamp 70, however, almost half of the reflected light from the elliptic type reflector 72 is shielded by the shade 74 as clearly shown in the above-described explanation, as a result the luminous flux efficiency to the light source 71 is lowered and there is another problem in that the lamp 70 is relatively darker for energy consumption.

Moreover, it has been proposed that with this type of a projector headlamp 70 provided is a luminous intensity distribution switching means for changing luminous intensity distribution properties for driving and for passing-by by retreating, for example, a shade 74 from the luminous flux of the light reflected from the elliptic type reflector 72. In this case, however, any control for the shape of the luminous intensity distribution property is not substantially carried out and there is still another problem in that any luminous intensity distribution property for practical use can not be obtained.

SUMMARY OF THE INVENTION

An object of the present invention is to provide a headlamp for a vehicle being capable of improving luminous flux efficiency to a light source and increasing its brightness further even when the same light source is used. Another object of the present invention is to provide a headlamp for a vehicle being capable of providing an original design for appearance of the headlamp which has not been existed without decreasing the luminous intensity even when the height thereof is decreased.

In order to achieve the above-mentioned objects, the present invention provides a headlamp for a vehicle, comprising a light source; a first reflector formed of a parabolic reflector and having a focal point at which the light source is positioned; a light guide passage for guiding light to the backside of the first reflector, provided at an appropriate position thereof; a second reflector formed of a parabolic reflector and provided outside thereof corresponding to the light guide passage of the first reflector; a third reflector provided in the vicinity of an optical axis of the first reflector for converging and transmitting a light from the light source to the vicinity of the light guide passage; and a lens provided in front of the first and second reflectors in an illuminating direction.

According to the headlamp for a vehicle of the present invention, light which is not captured by the first reflector and which has not been utilized in the prior art can be collected and utilized by the third reflector, thereby being capable of illuminating it in the illuminating direction by the second reflector via the light guide passage. As a result, there is provided a headlamp for a vehicle being capable of improving luminous flux efficiency to a light source and increasing its brightness further even when the same light source is used and also improving performance of the lamp.

In the design aspect, even when, for example, the height of the first reflector is decreased so that the captured quantity of luminous flux by the first reflector is decreased, the decreased quantity of luminous flux can be collected by the third reflector and utilized by the second reflector as a illuminating light. Accordingly, it is possible to provide an original design having a lens height of about 30 mm which has not been able to be obtained according to the prior art without deteriorating any performances as a headlamp. Thus, a superior effect to improve commercial value can be provided.

In the present invention, a focal point of the above-mentioned second reflector may be set in the vicinity of the light guide passage.

Further, the third reflector may be an elliptic type reflector having a first focal point at which the light source is positioned and a second focal point in the vicinity of which an inlet of the light guide passage is positioned.

In addition, the third reflector may serve as a hood for the light source.

Furthermore, an optical axis of the second reflector is almost parallel to the optical axis of the first reflector on at least one cross section in either horizontal direction or vertical direction.

Further, it is preferred that the optical axis of the second reflector may be set by about 2° downward relative to the optical axis of the first reflector.

Besides, the light guide passage may be provided above a horizontal line which passes through the light source and which is perpendicular to the optical axis and at a range of ±45° around the light source as the origin in a forward and backward direction relative to the horizontal line on the basis of the installation state of the headlamp for a vehicle.

Further, the light guide passage may have an inlet and an outlet which are appropriately spaced and may be tubular.

In addition, in the present invention, at least a part of the outlet of the light guide passage may contain a plane perpendicular to a straight line which is perpendicular to the optical axis of the second reflector.

Furthermore, the shape of the outlet of the light guide passage may be adjusted to be suitable to form a luminous intensity distribution property required for the second reflector.

Besides, an upper end of the light guide passage may coincide with at least one of an upper end of the first reflector and an upper end of the second reflector.

Furthermore, an upper end of the effective area of the lens may coincide with or may be set lower than a lower end of the light guide passage.

A top of the first reflector may be formed of convex protruding inside of the first reflector to reflect upward light reflected from the first reflector as a horizontal light or downward light.

The inside of the light guide passage may be treated by reflection treatment or may be filled with a light guide material.

Further, the first reflector may be a parabolic free curved surface and the third reflector may have a width at the front side of the light source wider than that at the back side of the light source.

A further object of the present invention is to provide a headlamp for vehicle, being capable of providing appropriate luminous intensity distribution properties for running and for passing-by.

The above-mentioned object of the present invention can be achieved by providing the following headlamp for a vehicle.

Namely, the present invention provides a headlamp for a vehicle, comprising: a light source; a first reflector formed of a parabolic reflector which is cut at upper arid lower portions thereof and having a focal point at which the light source is positioned, an optical. axis thereof being directed to an illuminating direction; a pair of second reflectors each formed of an elliptic type reflector provided above the first reflector so as that the major axis thereof is perpendicular to the optical axis in a horizontal direction, and having a first focal point at which the light source is positioned; a pair of third reflectors each formed of a parabolic reflector having a focal point at which a second focal point of each of the second reflectors is positioned, and provided at the both outsides of the first reflector; and a fourth reflector formed of a parabolic reflector having a focal point at which the light source is positioned, an optical axis thereof being directed to the illuminating direction, and provided below the first reflector.

According to the headlamp for vehicle of the present invention having the above-mentioned configuration, it becomes possible to provide appropriate luminous intensity distribution properties for running and for passing-by and resolve the problems in the prior art lamps which deteriorate the vehicle performances, and also to improve the performances of the vehicle headlamp.

In addition, it is possible to provide an original design of a headlamp when installing the headlamp into a vehicle to improve an original appearance and commercial value. Furthermore, luminous flux efficiency of the headlamp can be improved by removing the necessity of a hood or stripe to provide a brighter headlamp and to improve commercial value thereof.

In the above-mentioned headlamp for a vehicle, there may be further provided with a pair of first mirrors having their reflecting surfaces directing upward along the major axes of the second reflectors, respectively and provided in such a manner that tip ends thereof coincide with the second focal points of the second reflectors, respectively, and a pair of third mirrors having their reflecting surfaces directing to the light source side and provided at both sides of the light source, wherein one of the pair of first mirrors or the pair of third mirrors is movable in the vertical direction to change luminous intensity distribution.

Further, the tip ends of the pair of first mirrors may be asymmetric in an angle when intersecting with the major axis of the second reflector.

In addition, the tip ends of the pair of first mirrors may be perpendicular to the major axis, and the first mirrors may be tilted in an appropriate angle relative to the major axis as a rotation axis.

Furthermore, a border between light and shade of the luminous intensity distribution for passing-by may be formed by the tip ends of the first mirrors.

One of the tip ends of the first mirrors may form an elbow portion of the border between light and shade in the luminous intensity distribution for passing-by, and the other of the tip ends of the first mirrors may form a horizontal portion of the border between light and shade in the luminous intensity distribution for passing-by.

Further, a second mirror may be provided so as to direct a reflecting surface thereof to the first mirrors. Still further, the second mirror may be provided so as to receive a reflected light from the first mirror.

In addition, the first and second mirrors may be formed integrally.

Further, both the first and third mirrors may be moved in the same direction of either upper or lower direction to change the luminous intensity distribution.

In the above case, movement of the first mirrors may be simultaneously carried out with the movement of the third mirrors.

Furthermore, the third mirrors may preferably be inclined to shorten the distance between the upper ends thereof and widen the distance between the lower ends thereof.

In addition, the third mirrors may not have a reflecting function.

Furthermore, at least one of the first, second and third mirrors may be formed of a curved surface.

Alternatively, at least one of the first and third mirrors may be formed of a free curved surface.

BRIEF DESCRIPTION OF THE DRAWINGS

These and other objects arid advantages of the present invention will become clear from the following description with reference to the accompanying drawings, wherein:

FIG. 1 is a cross sectional view showing a prior art headlamp;

FIG. 2 is a cross sectional view showing another prior art headlamp;

FIG. 3 is a cross sectional view showing still another prior art headlamp;

DETAILED DESCRIPTION OF THE PREFERRED EMBODIMENTS

Hereinafter the present invention will be described in more detail by way of embodiments with reference to the accompanying drawings. Further, for easy understanding, this embodiment shows an example in which there are provided a pair of the second reflectors at both sides of the first reflector in a hiorizontal direction arid also provided are the light guide passage arid the third reflector corresponding to the second reflector. However, the number and the arranged position of the second reflectors are not limited to the embodiment. Also the number and the position of each of the light guide passage and the third reflector are not limited thereto. Further, the directions of back and front, up and down, and left and right are referred on the basis of the state where the vehicle installed the headlamp 21 is seen by a driver.

Figure 4:
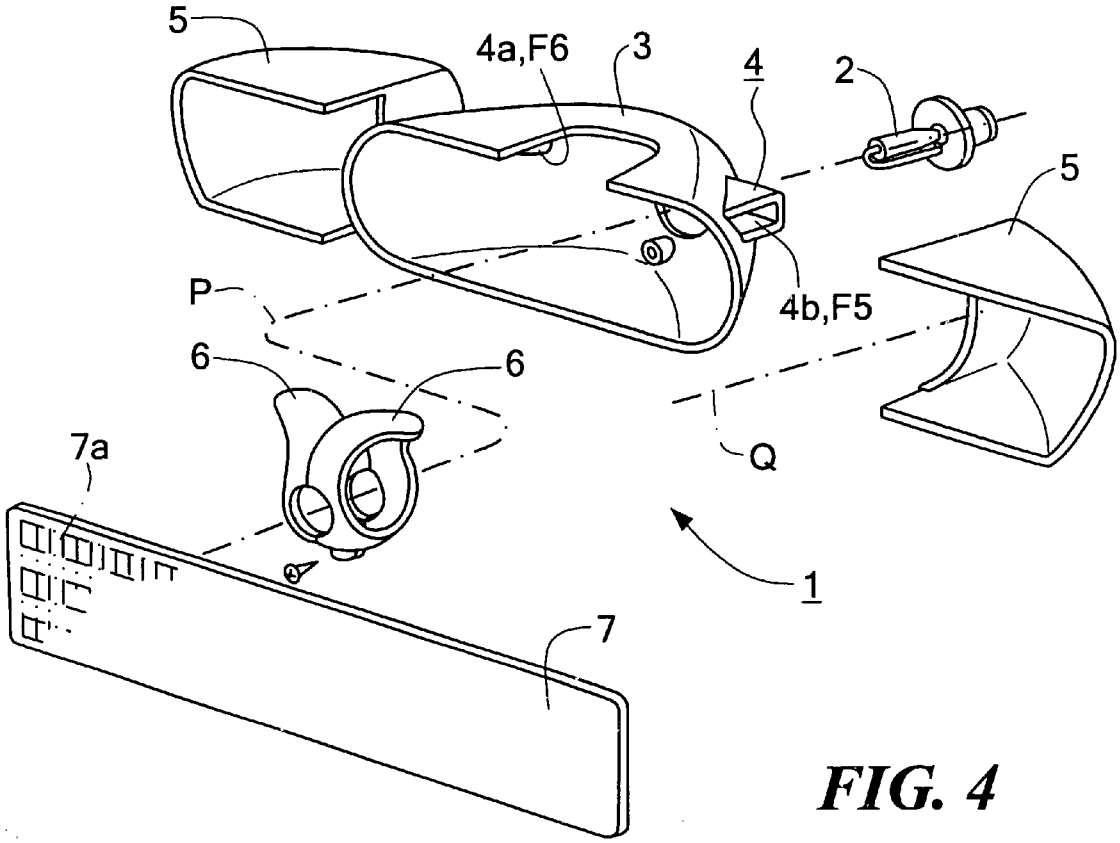
FIG. 4 is a perspective view showing a first embodiment of a headlamp for a vehicle according to the present invention, a part of which is disassembled.

The first embodiment according to the present invention is shown in FIG. 4. Reference numeral 1 designates a headlamp for a vehicle according to the present invention. The headlamp 1 for a vehicle is composed of a light source 2, a first reflector 3 provided with light guide passages 4, second reflectors 5, third reflectors 6, and a lens 7 as main components.

The first reflector 3 is a parabolic reflector which has a focal point where the light source 2 is positioned and which is a revolved parabolic reflector or a free curved surface. Light from the light source 2 is reflected by the first reflector 3 to provide parallel light or appropriately widened light in the illuminating direction through the lens 7. The function thereof is almost the same as that of the conventional example shown in FIG. 1 or 2.

When a metal halide discharge lamp is employed as the light source 2, it tends to generate colored light emitted from the lower half of the light source 2. In this case, the optical axis P of the first reflector 3 may set below the center of the vertical width (height) of the first reflector 3 so as Lo capture the light emitted front the upper half of the light source 2 as much as possible.

The light guide passages 4 are provided on the first reflector 3. The position and shape of the light guide passage 4 may be determined in relation to the second reflectors 5 and the third reflectors 6. Such a determination will be described hereafter in the below-mentioned description for the second reflectors 5 and the third reflectors 6.

The second reflector 5 is a parabolic reflector which has a focal point F5 such as a revolved parabolic reflector or a free curved surface like the first reflector 3. The focal point F5 is set to be positioned in the vicinity of an outlet 4*b* of the light guide passage 4. An optical axis Q of the second reflector 5 is in parallel with the optical axis P of the first reflector 3.

A pair of the second reflectors 5 are provided at both sides of the first reflector 3 in a state where the headlamp 1 is installed into vehicle, respectively. Accordingly, the respective light guide passages 4 are provided on the right and left sides of the first reflector 3 corresponding to the positions where the second reflectors 5 are arranged. Incidentally, in this embodiment the respective light guide passages 4 are provided at the symmetric positions relative to the vertical line passing through the light source 2.

The third reflector 6 is formed of a part of a revolved elliptic type reflector.

The revolved elliptic type reflector has its first focal point positioned at or in the vicinity of the light source 2 and its second focal point F6 at or in the vicinity of an inlet 4*a* of the light guide passage 4, and is formed by revolving an ellipse around its major axis passing through both the focal points. As described above, in the present embodiment a pair of the light guide passages 4 are provided at the respective positions of the first reflector 3, and accordingly there are provided a pair of the third reflectors 6.

In this case, since the pair of third reflectors 6 have the first focal points where the light source 2 is arranged, the third reflectors 6 are arranged inside the first reflector 3 which has its focal point at the same position, i.e. the position of the light source 2. Thus, the first reflector 3 and the third reflectors 6 are interfered with each other. Furthermore, the pair of third reflectors 6 are interfered with each other. Accordingly, when the third reflector 6 is designed, distribution of the light from the light source 2 to the first reflector 3 and the third reflectors 6 should be considered. Light reaching the first reflector 3 from the light source 2 is basically reflected by the first reflector 3, where the third reflectors 6 are appropriately cut, and further luminous flux which reaches an area other than the first reflector 3 is converged at the inlet 4*a* of the light guide passage 4 by the third reflector 6. In addition, the third reflectors 6 are so constructed that such an interference therebetween is not generated by cutting the interfered portion of the third reflectors 6.

Here, in the construction of this type of the headlamp 1 for a vehicle, usually a hood is provided to shield a part of the reflector where reflected light cannot contribute to form luminous intensity distribution properties and to shield direct light from the light source 2 to the opposed vehicles by preventing dazzling light from being generated.

The third reflectors 6 are so constructed that light which does not reach the first reflector 3 is utilized. Accordingly, the light captured by the third reflector 6 is almost the same light conventionally shielded by a hood. Thus, the third reflector 6 can serve as a hood if the third reflector 6 is so constructed that the light which does not reach the first reflector 3 is captured by the third reflector 6.

Furthermore, in case where a discharge type light source called as D2R type is employed, in order to facilitate provision of luminous intensity distribution for passing-by a bulb of the discharge light source is directly provided with a shielding film. In this case, if a discharge lamp not provided with any shielding film is employed to utilize the un-shielded light conventionally having been un-utilized is captured and utilized by the third reflector 6, a further improvement of the luminous flux efficiency can be obtained. If the third reflector 6 is utilized for serving as the shielding film described above, it becomes unnecessary to provide two types of discharge lamps for right-side traffic and left-side traffic and rationalization of production thereof can be achieved.

The lens 7 covers the front sides of the above constructed light source 2, the first reflector 3, the second reflectors 5 and the third reflectors 6. In addition, when the first reflector 3 and the second reflectors 5 are formed of revolved parabolic reflectors, the lens 7 is provided with lens cuts 7*a* to form a luminous intensity distribution property. When the first reflector 3 and the second reflectors 5 are free curved surfaces, both reflectors 3 and can form a desired luminous intensity distribution directly and the lens 7 does not substantially need to have lens cut formed thereon. Here, according to the results of the inventors' studies to complete the present invention, the light converged at the vicinity of the inlet 4*a* of the light guide passage 4 by the aforementioned third reflector 6 is reflected by the inner surface of the light guide passage 4 when the light passes through the light guide passage 4 and reach the outlet 4*b*. As a result, the light emitted from the outlet 4*b* will be lost its regularity such as directivity.

Figure 5:
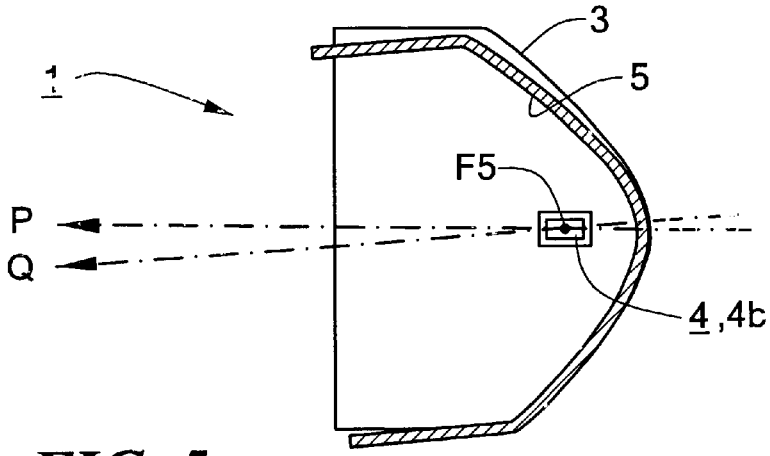
FIG. 5 is a cross sectional view showing an essential part of a second embodiment of a headlamp for a vehicle according to the present invention.

Thus, in an actual practice, like as the second embodiment shown in FIG. 5, it is confirmed that the second reflector 5 should be designed not to generate an upward light when it is reflected and lost its regularity, and that the optical axis Q thereof is preferably set downward by about 2° relative to the illuminating direction.

Next, explanation will be made on the function and advantage of the headlamp 1 for a vehicle according to the present invention constructed as above. In the present invention, light from the light source 2 which is not captured by the first reflector 3 is utilized by providing the third reflectors 6 formed of the revolved elliptic reflector-to reflect it as an illuminating light from the second reflectors 5 via the light guide passages 4. Accordingly, it is possible to implement a brightener headlamp with the same light source 2 by improving the luminous flux efficiency of the light source 2.

As to the outer appearance, in the prior art, if the width of the reflector in the vertical direction (height) becomes small, the headlamp inevitably becomes darker due to the decrease in reflecting area. According to the present invention, however, luminous flux which becomes un-utilizable due to the decrease in reflecting area of the first reflector 3 can be collected by the third reflectors 6 and guided to the second reflectors 5, thereby preventing it from being darkened. As a result, it is possible to design a headlamp having a lens with its width of 30 mm in the vertical direction, thereby enabling of implementing an original designed headlamp 1 for a vehicle which has not been implemented by the prior art.

In the first embodiment, light guide passage 4, second reflector 5, and third reflector 6 are provided as a pair of ones at the right and left sides, respectively. However, in the present invention, the numbers and positions of light guide passage 4, second reflector 5, and third reflector 6 are not limited thereto, but freely set appropriately.

Figure 6:
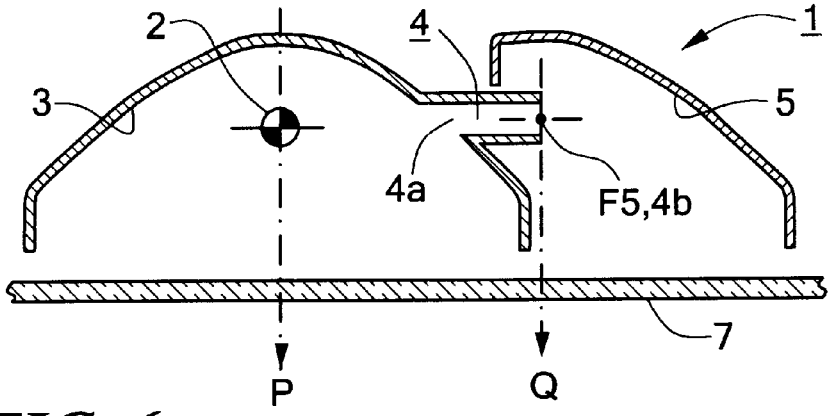
FIG. 6 is a cross sectional view showing a third embodiment of a headlamp for a vehicle according to the present invention.

For example, when a composite lamp provided with an auxiliary headlamp (such as fog lamp) at inner side of vehicle is employed, if the second reflectors 5 are arranged at the right and left outsides of the first reflector 3, an area occupied with the headlamp is too large, resulting in losing of any space for the auxiliary headlamp. In the above case, there is provided another example of the headlamp 1 for a vehicle shown in FIG. 6 as the third embodiment. Here, the headlamp 1 for a vehicle is shown as a cross section along the horizontal direction when the headlamp is installed. In the headlamp 1 for a vehicle, the second reflector 5 is provided only at the outer side of the first reflector. Accordingly, single light guide passage 4 and single third reflector 6 are provided corresponding to the second reflector 5 to ensure the space for the provision of the auxiliary headlamp.

Furthermore, if a pair of the second reflectors 5 are provided, the position therefor is not limited to the horizontal direction. For example, although drawings are not present, the headlamp 1 of the first embodiment is rotated about the optical axis P by 90° and the lens cuts 7*a* provided on the lens 7 are changed corresponding to the arrangement of the second reflectors to obtain another headlamp 1 being longitudinally long in outer appearance.

Figure 7:
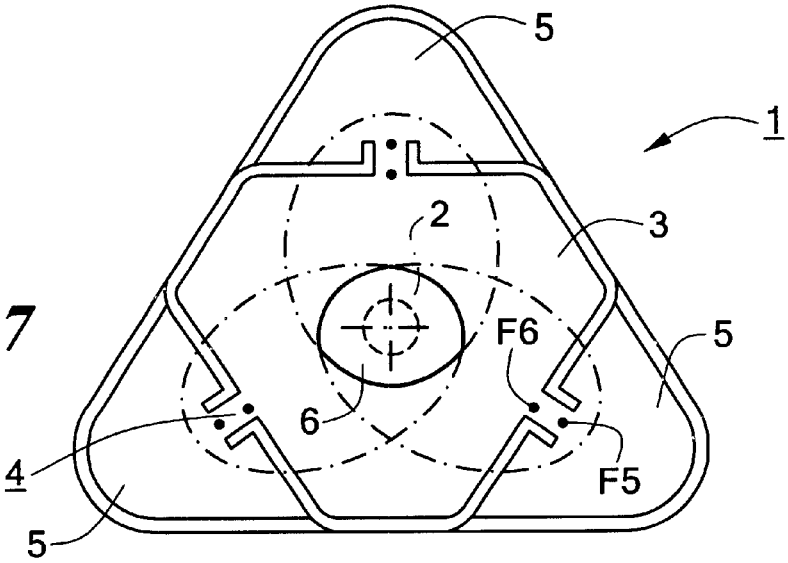
FIG. 7 is a front view showing a fourth embodiment of a headlamp for a vehicle according to the present invention.

Furthermore, the second reflector 5 can be provided at two or more positions. FIG. 7 shows the fourth embodiment in which the second reflectors are provided at the upper portion, and lower horizontal sides of the first reflector 3. In this case, the light guide passage 4 and the third reflector 6 are provided in the same number corresponding to the number of the second reflector 5.

Figure 8:
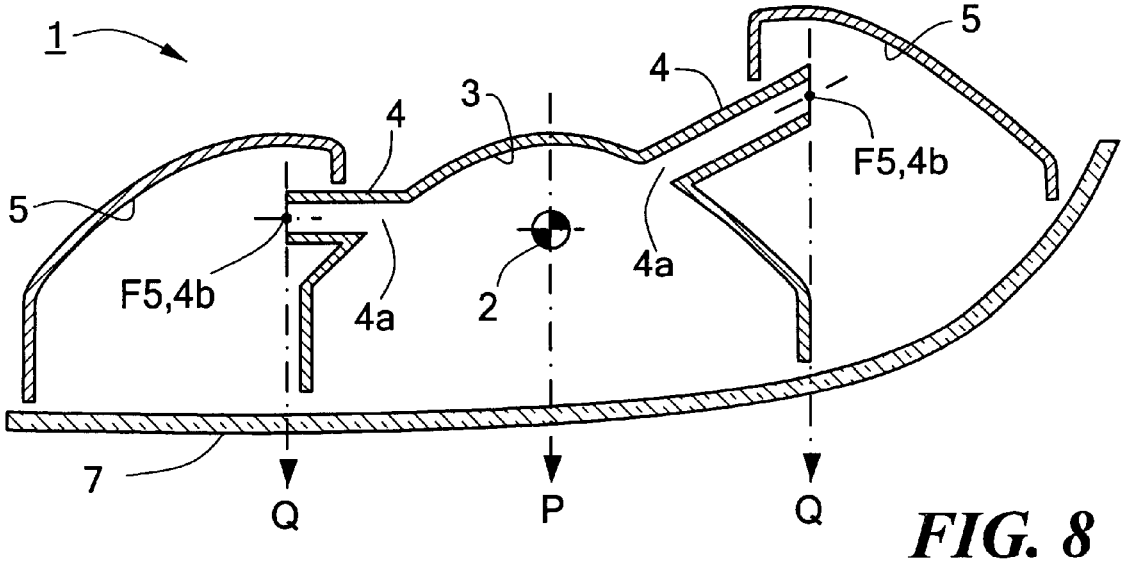
FIG. 8 is a cross sectional view showing a fifth embodiment of a headlamp for a vehicle according to the present invention.

In the first to fourth embodiments, when plural second reflectors are provided, basically the second reflectors 5 are arranged so as to be set at the same position in the front and rear direction along with the optical axis P of the light source. However, the present invention is not limited thereto. That is, as shown in FIG. 8 as a horizontal cross section of the fifth embodiment, a pair of second reflectors 5 provided at the right and left outsides of the first reflector 3 are shifted with each other in the front and rear direction. Thus, corresponding to this arrangement, the light guide passages 4 and the third reflectors 6 are not symmetric. According to this arrangement, if a lens 7 curved to fit a curved side body of a vehicle is employed, the first reflector 3 and the second reflectors 5 are arranged all over the backside of the lens 7, thereby enabling of the entire illumination of the headlamp.

Figure 9:
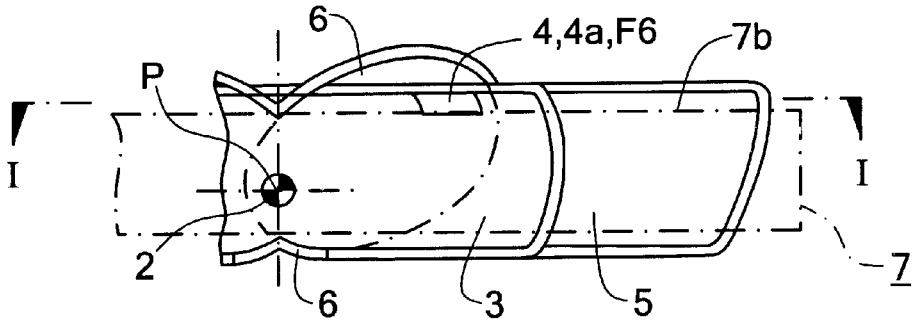
FIG. 9 is a front view showing a sixth embodiment of a headlamp for a vehicle according to the present invention.
Figure 10:
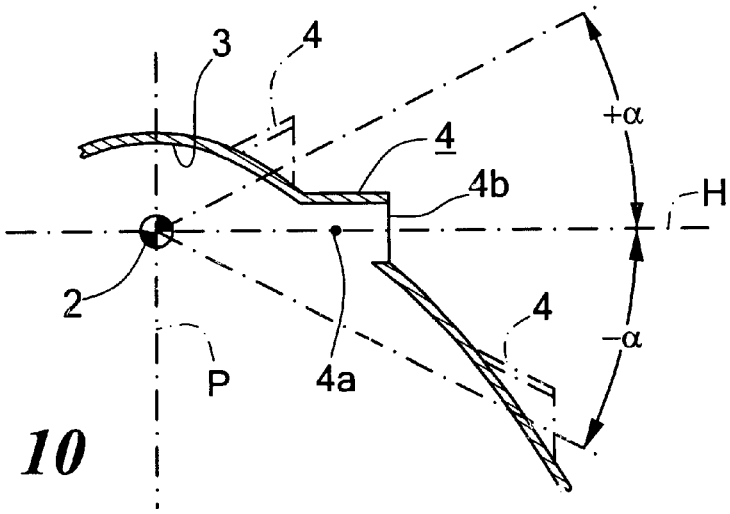
FIG. 10 is a cross sectional view taken along the I—I line of FIG. 9.

FIGS. 9 and 10 show essential parts of headlamp 1 for a vehicle of the sixth embodiment according to the present invention. This sixth embodiment relates to a feature which is the position where the light guide passage 4 is provided. As a result of the examination by the inventors, when an ellipse having a larger ratio of the major axis to the minor axis is employed as the revolved elliptic reflector of the third reflector 6, the interfered quantity to the first reflector 3 is decreased while the cut amount therefor is also decreased which is preferred. Thus, it was found that the luminous flux captured by the third reflector 6 become increasing tendency.

Further, as described above, when a discharge lamp is employed as the light source 2, the optical axis P of the first reflector 3 is set lower. Accordingly, in order to set the major axis thereof longer, the light guide passage 4 (where the second focal point F6 of the third reflector is positioned) is preferably arranged at the same level or higher than the horizontal line H passing through the optical axis P. As shown in the drawings, the light guide passage 4 is provided at the upper end of the first reflector 3 so as to make the major axis longest (refer to FIG. 9).

The length of the major axis of the revolved elliptic reflector forming the third reflector 6, as shown in FIG. 10, can also be changed by shifting the light guide passage 4 in the front and rear direction relative to the optical axis P of the first reflector 3. When the light guide passage 4 is shifted forward (in the figure, in the direction of the $-\alpha$ degree), the major axis can be set longer. However, interfered quantity between the first reflector 3 and the third reflectors 6 becomes large. Therefore, cut quantity must be increased, but sufficient effect cannot be obtained.

On the other hand, when the light guide passage 4 is shifted backward (in the figure, in the direction of the $+\alpha$ degree), the major axis is set shorter, and interfered quantity between the first reflector 3 and the third reflectors 6 become small. However, the interfered quantity between the first reflector 3 and the second reflectors 5 become large, and accordingly also sufficient effect cannot be obtained. Accordingly, in the present invention the light guide passage 4 should be set in the direction of the $\alpha$ degree of ±45° on a plane including the horizontal line H and the optical axis P on the basis of the horizontal line H perpendicular to the optical axis P passing through the light source 2.

Here, if the light guide passage 4 is arranged near the upper ind of the first reflector 3 which is above the light source 2, the reflected light generated by the third reflector 6 become upward. In this case, when the reflected light by the third reflector 6 reach the first reflector 3, the light reflected thereby become upward, or a dazzling light.

In the present invention, the position of the light guide passage 4 relative to the lens 7 is regulated to prevent any dazzling light from generating. As shown in FIG. 9 by two-dot chain line, the upper end 7*b* of the effective area of the lens 7 may coincide with the lower end of the inlet 4*a* of the light guide passage 4 or lower, the upward light which reaches the first reflector 3 from the third reflector 6 and is reflected thereby may not emit outward whereas reaching the lens 7, thereby preventing any dazzling light from generating.

Figure 11:
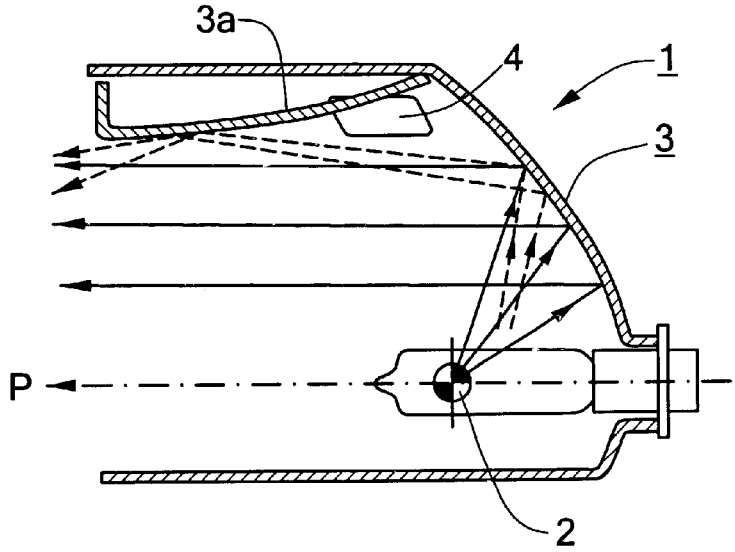
FIG. 11 is a cross sectional view showing a seventh embodiment of a headlamp for a vehicle according to the present invention.

In addition, such prevention of dazzling light may be implemented by changing the shape of a ceiling plate 3*a* of the first reflector 3. FIG. 11 shows the seventh embodiment. The ceiling plate 3*a* is formed of a convex curved surface of which tangent lines become downgrade along the direction of the light reflected by the first reflector 3, i.e., which projects inwardly to the first reflector 3. The ceiling plate 3*a* can convert the upward light to downward one, thereby prevent any dazzling light from generating. In this case, the gradient of the tangent at every portion of the ceiling plate 3*a* is appropriately adjusted so that the reflected light reaches an arbitrary position to form a desired luminous intensity distribution.

Figure 12:
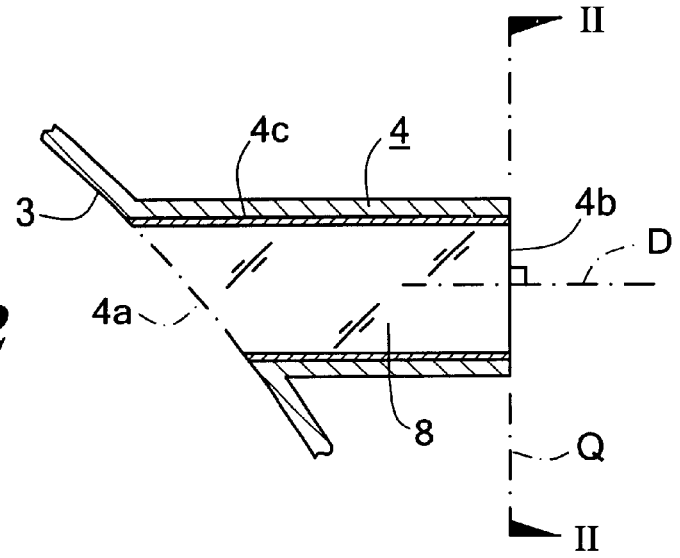
FIG. 12 is a cross sectional view showing an essential part of an eighth embodiment of a headlamp for a vehicle according to the present invention.

FIG. 12 shows an essential part of the eighth embodiment according to the present invention. In the construction of the present invention, the second reflector 5 is formed of revolved parabolic reflector or the like having its focal point F5 at a position where the outlet 4*b* of the light guide passage 4 is positioned. Namely, the position where the second reflector 5 is arranged is set according to the outlet 4*b* of the light guide passage 4. As a result, depending on the position of the outlet 4*b*, the second reflector 5 may be overlaid with the first reflector 3. Accordingly, the light reflected from the second reflector 5 may not be used effectively.

In view of the foregoing, in the present invention an appropriate space is provided between the inlet 4*a* and the outlet 4*b* by forming an almost tubular shape for the light guide passage 4. For example, when the space between the inlet 4*a* and the outlet 4*b* are widened, the second reflector 5 can be arranged more outward, thereby decreasing the interfered quantity with the first reflector 3.

In this case, in order to prevent loss of light within the light guide passage 4, it can be compensated by providing a reflection treatment on the inside of the light guide passage 4, such as an aluminum vapor deposition to form a reflector 4*c*. Alternately, inside the light guide passage 4 a light guide member 8, such as an optical fiber, a light guide plate (block) made of transparent resin and the like, may be filled. Further, formation of the reflector 4*c* may be implemented with the filling of the light guide member 8.

Figure 13:
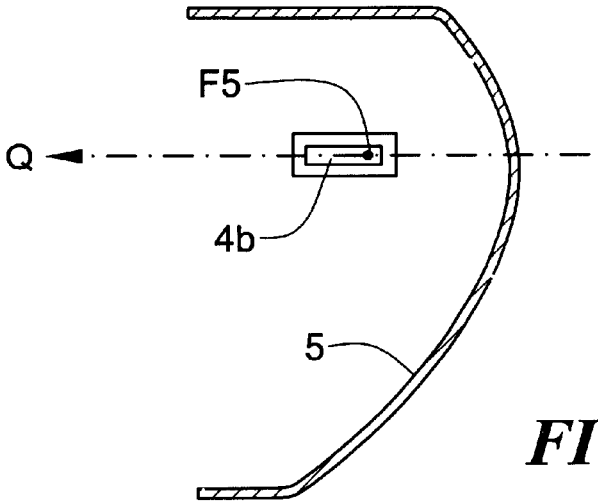
FIG. 13 is a cross sectional view taken along the II—II line of FIG. 12.

The present invention also provides a preferred shape of the outlet 4*b* of the light guide passage 4. As discussed above, the outlet 4*b* of the light guide passage 4 functions as a light source for the second reflector 5. The plane formed by the outlet 4*b* may be designed as a plane having a normal line D perpendicular to the optical axis Q of the second reflector 5. More preferably the shape of the outlet 4*b* may be designed, as shown in FIG. 13, as a rectangle having a longer side along the optical axis Q As a result, a virtual image of the light source 2 at the outlet 4*b* appears, like as a C-8 type filament, while it coincides with the optical axis Q in a longitudinal direction. Accordingly, the reflected light by the second reflector 5 may be similar to that in the case where the C-8 filament is employed. When a lens cut to be provided is designed at a position of the lens 7 corresponding to the second reflector 5, it is possible to apply a conventional technique therefor. Thus, it is unnecessary to employ an advanced and difficult technique to implement the present invention, thereby facilitating carrying out of the invention.

Figure 14:
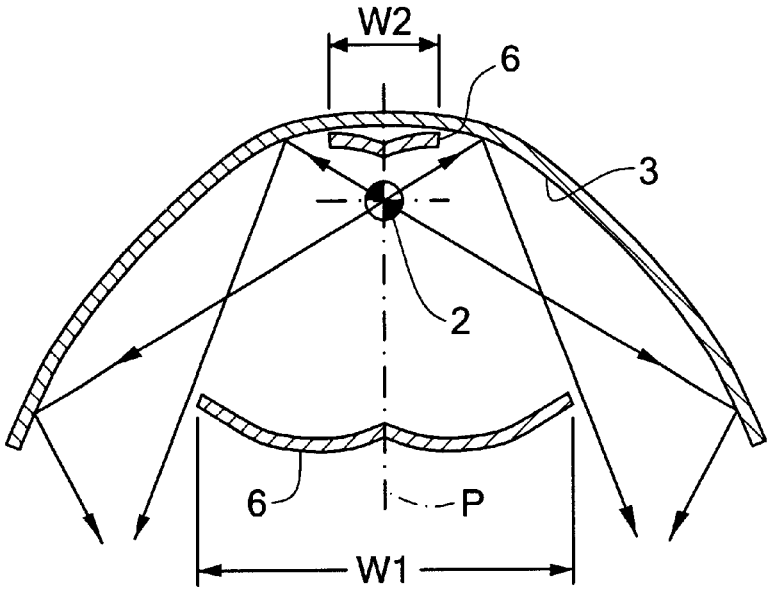
FIG. 14 is an explanatory view showing an essential part of a ninth embodiment of a headlamp for a vehicle according to the present invention.

FIG. 14 shows the ninth embodiment. In this embodiment according to the present invention, the first reflector 3 can employ a revolved parabolic reflector by which a reflected light becomes a parallel light, or a parabolic free curved surface by which a reflected light may have a desired luminous intensity distribution. Here, when a free curved surface is employed, the direction of the light reflected at each portion of the reflecting surface may be set freely.

By utilizing this characteristic, the first reflector 3 is formed of a free curved surface while it is designed so as to generate an outwardly reflected light at a portion thereof in the vicinity of the third reflector 6, i.e. in the vicinity of the central portion (optical axis P). In this case, the third reflector 6 does not interfere with the light reflected from the first reflector 3 and the width W1 at the front side of the light source 2 may be wider than the width W2 of the reflector at the back side of the light source 2.

Here, the reflecting surface of the third reflector 6 at the front side of the light source 2 may capture a light from the light source 2 which has never been captured by the first reflector 3. Accordingly, by widening the width W1 at this position the captured quantity of luminous flux from the light source can be increased, thereby implementing a brightener lamp with the same light source 2.

Figure 15:
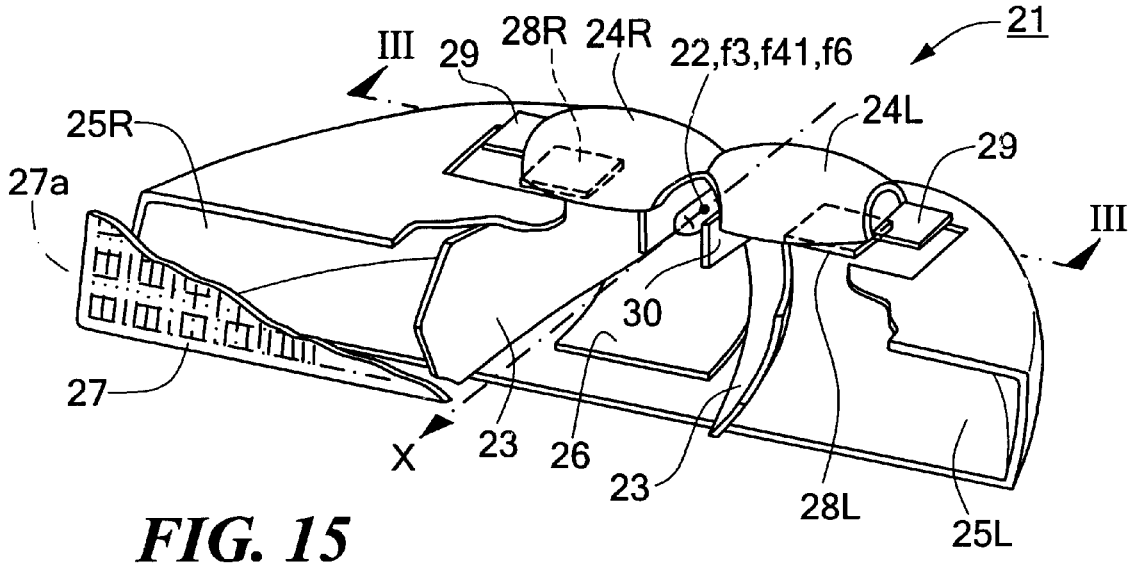
FIG. 15 is a perspective view showing still another embodiment of a headlamp for a vehicle according to the present invention.
Figure 16:
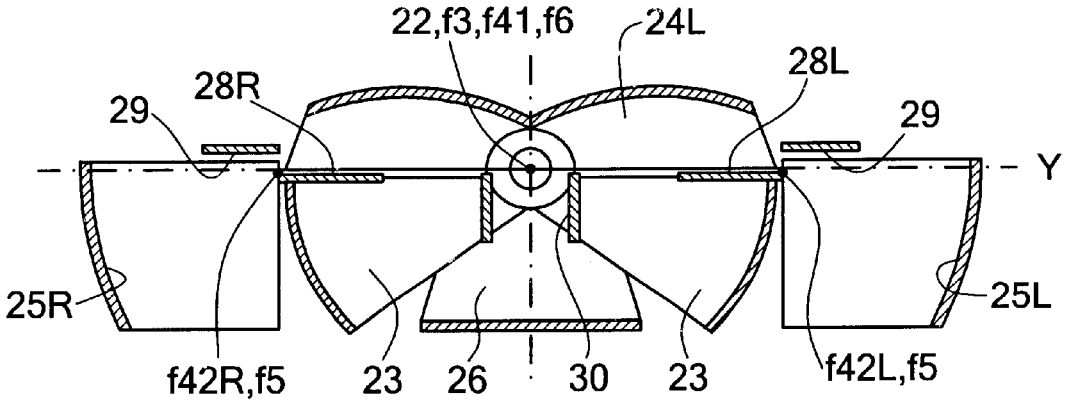
FIG. 16 is a cross sectional view taken along the III—III line of FIG. 15.

Next, the present invention will be explained with reference to further embodiments. Besides, in the present invention, the directions of back and front, up and down, and left and right are referred on the basis of the state where the vehicle installed the headlamp 21 is seen by a driver. In FIGS. 15 and 16, reference numeral 21 denotes a headlamp for a vehicle according to the present invention (hereinafter simply called as a headlamp 21). This headlamp 21 employs a bulb having single light source 22 such as a metal halide discharge lamp as a light source.

In the present invention, a first reflector 23 is provided. The first reflector 23 is formed of a parabolic reflector such as a revolved parabolic reflector, a free curved surface or the like, and has a focal point f3 where the light source 22 is arranged. In this case, the axis of the first reflector 23 coincides with the optical axis X of the headlamp 21. Further, the first reflector 23 is formed by cutting its upper and lower portions.

In the present invention, at the upper space of the first reflector 23 cut as described above, there are provided a pair of second reflectors 24L, 24R.

The second reflectors 24L, 24R are formed of elliptic reflectors such as a revolved ellipse. The light source 22 coincides with respective first focal points f41L, f41R thereof. The major axis Y thereof is crossed at right angle with the optical axis X in a horizontal direction. Accordingly, the second focal points f42L, f42R of the second reflectors 24L, 24R are positioned on the major axis Y, respectively and arranged outward relative to the light source 22.

In addition, the present invention provides a pair of third reflectors 25L, 25R outside the aforementioned first reflector 23. The third reflector 25L is formed of a parabolic reflector such as a revolved parabolic reflector, a free curved surface and the like. The focal point f5 of the reflector coincides with the second focal point f42 of the second reflector 24L positioned in the same direction. Here, the headlamp of the example is symmetric, and accordingly, the explanation for the third reflector 25R is omitted.

Here, since the first reflector 23 is formed by cutting its upper and lower portions, there is a space at the lower portion thereof same as the upper portion thereof where the second reflectors 24L, 24R are provided. In this space, there is provided a fourth reflector 26 formed of a parabolic reflector such as a revolved parabolic reflector or a parabolic columnar reflector, having a focal point f6 where the light source 22 is arranged.

Further, there is provided a lens 27 for covering the light source 22, the first reflector 23, the second reflectors 24R, 24L, the third reflectors 25R, 25L, and the fourth reflector 26 from front sides thereof. Lens cuts 27*a* are provided at appropriate portions on the lens 27, if necessary. A hood (not shown) for preventing direct light through the lens 27 from the light source 22 to outside may be optionally provided in the headlamp 21 of the present invention.

In the present invention, first mirrors 28L, 28R and 20 second mirrors 29 are provided corresponding to the focal points f42L, f42R of the second focal point 24L, 24R as essential components. The pair of first mirrors 28L, 28R have planes coinciding with the major axis Y and the outermost ends thereof are matched with the second reflectors 24L, 24R, respectively. The reflecting surfaces thereof are upwardly directed. Between the second mirrors 29 and the first mirrors 28R, 28L, there is provided an appropriate space and the reflecting surfaces of the second mirrors 29 face the first mirrors 28R, 28L, respectively. The second mirrors 29 are appropriately arranged outside the second focal points f42L, f42R.

A pair of third reflectors 30 are provided so as to face the light source 22. Besides, the first mirrors 28R, 28L and the third mirrors 30 may be movable in the vertical direction by an appropriate drive device (not shown) such as a solenoid in the present embodiment, which will be described later. Thereby a luminous intensity distribution for passing-by and a luminous intensity distribution for running may be changed. In the present invention, there is no need to make both of them movable, but any one of them may be moved when the headlamp is dedicated for, for example, a headlamp for passing-by.

Next, another practicable construction for the first mirrors 28R, 28L, second mirrors 29, and third mirrors 30 will be explained. In this case, the first mirrors 28R, 28L are arranged in the vicinity of the second mirrors 29 with a higher accuracy in dimension with each other. Accordingly, if the first mirrors 28R, 28L is not movable, they may integrally formed in one piece preferably. According to this construction, an assembly step for the headlamp 21 can be decreased and also an accuracy therefor can be improved.

Next, consider that the first mirrors 28R, 28L and the third mirrors 30 are made movable and solenoids are attached to both first and third mirrors to change its luminous intensity distribution. In this case, since a power consumption during the start up of the solenoid is large, it may be considered that a load to the power source may be increased. To resolve such a problem, if the first mirrors 28R, 28L are first to be moved and the movement of the third mirror 30 is delayed (and vice versa), the power consumption may be equalized.

In the above description, the respective mirrors 28R-30 are formed of plane mirrors. However, the present invention is not limited thereto. For example, when the required headlamp needs to have a shape which is longitudinally narrow and horizontally wide, the mirrors arc formed of appropriate curved surfaces, respectively, depending on the required luminous intensity distribution to cause light to be incident on the respective mirrors.

Figure 17:
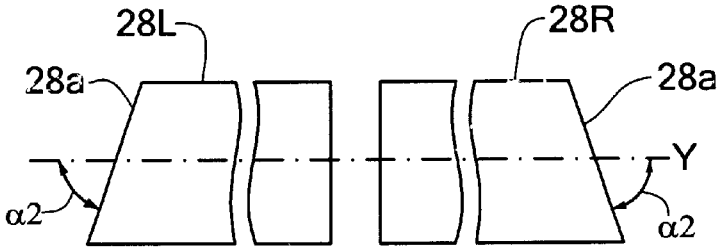
FIG. 17 is an explanatory view showing an example of the first mirror of a headlamp for a vehicle according to the present invention.
Figure 18:
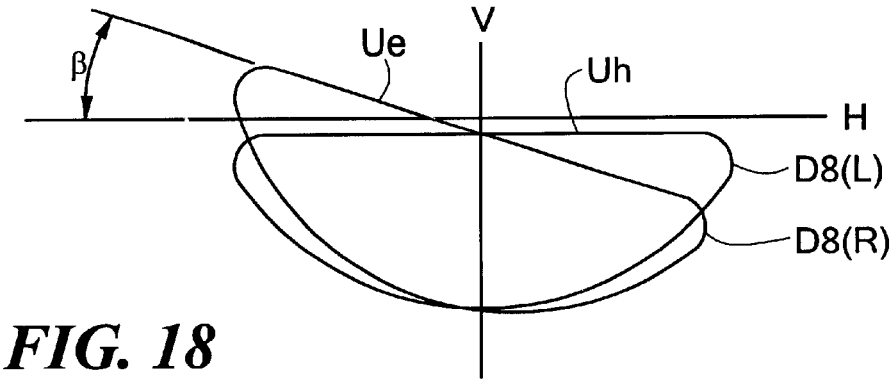
FIG. 18 is an explanatory view showing an example of luminous intensity distribution property formed by the shape of the first mirror of the headlamp for a vehicle according to the present invention.

Next, function and advantage of the headlamp 21 according to the present invention as constructed above will be described. Here, for easy understanding, functions of the first mirrors 28R, 28L and the second mirrors 29, which are the essential elements of the present invention, will be explained first. FIGS. 17 and 18 show the relationship between the shapes of the outer tip ends 28*a* of the first mirrors 28R, 28L and the luminous intensity distribution. The first mirrors 28R, 28L are arranged in the vicinity of the respective focal points f42 of the second reflectors 24R, 24L which are elliptic reflectors. Accordingly, the tip ends 28*a* of the first mirrors 28R, 281, have almost the same function as a shielding plate in the conventional projector type headlamp.

Figure 19:
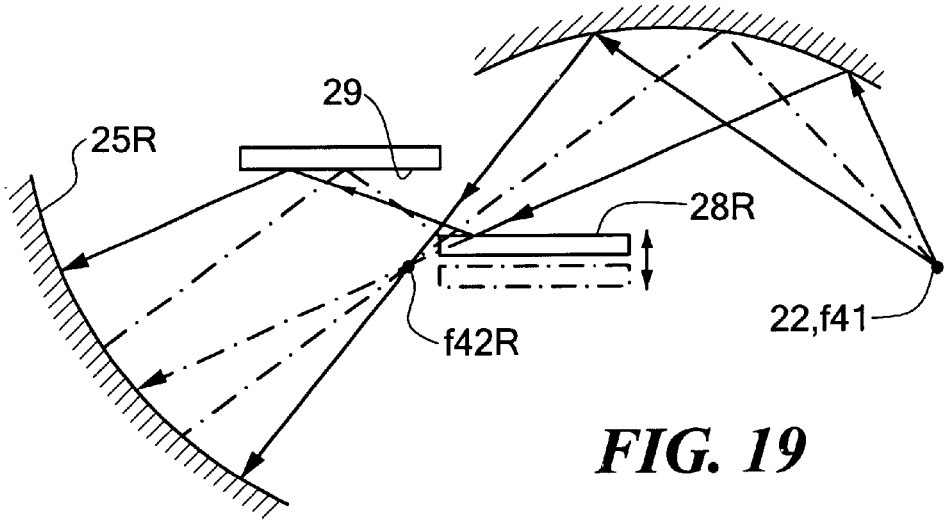
FIG. 19 is an explanatory view showing the relationship between the first and second mirrors of the headlamp for a vehicle according to the present invention.

Accordingly, if the angle $\alpha 2$ of the tip end 28*a* relative to the major axis $\beta$ is appropriately set (refer to FIG. 17), the inclined angle f of the border U between light and shade of the luminous intensity distributions D8L, D8R projected forward via the third reflectors 25L, 25R may be adjusted. In the present invention, the respective angle $\alpha 2$ of the tip ends 28*a* of the right and left first mirrors 28R, 28L are set different values so as that one of the pair of first mirrors 28R, 28L, for example the first mirror 28R can form the border Ue between light and shade inclined by 15° in a right direction as shown in FIG. 19, and the other one, for example the first mirror 28L can form the horizontal border Uh between light and shade.

According to the results of the inventors' studies to complete the present invention, it was confirmed that when the first mirrors 28R, 28L of which tip ends 28*a* are perpendicular to the major axis Y ($\alpha$=90°) are suitably inclined about the major axis Y as a rotational axis, the same function can be obtained as that in which angle of the respective tip ends 28*a* are changed.

As a result, according to the present invention, since light from the pair of the second reflectors 24R, 24L, light from the pair of the first mirrors 28R, 28L, and light from the third reflectors 25R, 25L are combined in the illuminating direction, a basic shape of the luminous intensity distribution for passing-by can be obtained. Further, lens cuts 27*a* are formed in a suitable manner on a portion of the lens 27 through which the reflected light from the third reflector 25L passes and a portion of the lens 27 through which the reflected light from the third reflector 25R passes. As a result, the illuminating width can be widened and a practical luminous intensity distribution for passing-by can be obtained.

Figure 20:
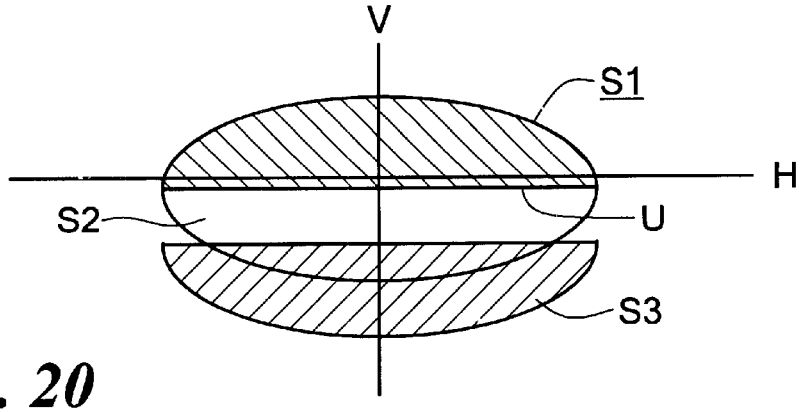
FIG. 20 is an explanatory view showing the change in the shape of the luminous intensity distribution property occurred due to the movement of the first mirror of the headlamp for a vehicle according to the present invention.
Figure 21:
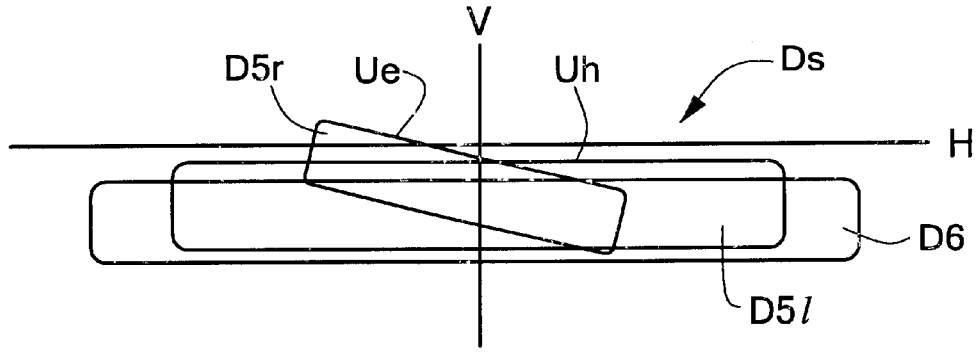
FIG. 21 is an explanatory view showing a luminous intensity distribution for passing-by of the headlamp for a vehicle according to the present invention.

FIGS. 20 and 21 are explanatory views showing the function of the second mirrors 29. Here a right half of the headlamp will be exemplified. The first mirror 28R is inserted into luminous flux converged on the second focal point f42R of the second reflector 24R. Accordingly, almost a half of the light reflected by the first mirror 28R is shielded, resulting in lowering of the luminous flux efficiency relative to the light source 2.

The second mirror 29 is means for preventing the luminous flux from being lost. The light which is reflected from the second reflector 24R and which is incident on the first mirror 28P is reflected by the first mirror 28R and reaches the second mirror 29. The light reflected by the second mirror 29 is reversed in direction to have a further downward component of light, and reaches the third reflector 25R. Besides, as clearly described above, the function of the second mirror 29 is to compensate the first mirror 28R. Accordingly, if the loss of light by the first mirror 28R is negligible, it can be omitted.

FIG. 20 shows a cross section of the luminous flux to explain the function of the first mirror 28R and the second mirror 29. In the figure, reference sign S1 (shown as an ellipse) is a cross section of illuminating light from the third reflector 25 when the first mirror 28R is not provided. The cross section S1 does not form a clear border U between light and shade and comprises a large quantity of upward light. When the first mirror 28R is inserted into the light reflected from the second reflector 24R, a cross section S2 (shown as a lower half of the ellipse) forming a border U between light and shade can be obtained and the upward light may be shielded.

Here, the hatching portion in the cross section S1 would be lost just as it is. However, by providing the second mirror 29, luminous flux having been lost can reach the third reflector 25. As a result, the hatching portion in the cross section Si appears under the cross section 52 in an inverted shape as a cross section S3, thereby enabling to utilize the light shown as the hatching portion. source 22 reaches the first reflector 23.

Further, the third mirrors 30 provided at the right and left sides of the light source 22 are moved in synchronization with the first mirrors 28R, 28L. When the first mirrors 28R, 28L are positioned above, the third mirrors 30 are also positioned above to shield light reaching the first mirrors 28R, 28L are moved downward, the third mirrors 330 are also moved downward to make the light from the light source 22 reach the first reflector 23.

That is the description for the essential elements construction of the headlamp 21 for a vehicle according to the present invention. Next, the function of the headlamp 21 will be described on the basis of the aforesaid description. First, FIG. 21 shows a luminous intensity distribution Ds for passing-by for the headlamp 21. Here, the first mirrors 28R, 28L and the third mirrors 30 are positioned above.

Accordingly, the first mirrors 28R, 28L are inserted into the light passages directed to a forward direction (illuminating axis X) by the third reflector 25R, 25L via the second reflectors 24R, 24L, respectively. Thereby, upward light can be shielded so that the desired luminous intensity distribution Ds for passing-by can be obtained. Since the second mirrors 29 reflect the light shielded by the first mirrors 28R, 28L, respectively, to utilize it, almost all of the luminous flux from the light source reflected by the second reflectors 24R, 24L reach the third reflectors 25R, 25L.

Further, in the present invention, for example a luminous intensity distribution D5r having a border Ue between light and shade upward by 15° right, so-called elbow portion, is formed by the tip end 28*a* of the first mirror 28R. Another luminous intensity distribution D51 having a border Uh between light and shade which border is horizontal and exists below the horizontal line H is formed by the tip end 28*a* of the first mirror 28L. Accordingly, the same illuminating precision can be obtained as one generated by the projector type headlamp, which is considered as the best one, by providing the total luminous intensity distribution Ds for passing-by.

In addition to this, in the luminous intensity distribution Ds for passing-by the first reflector 23 is shielded by the third mirrors 30. Accordingly, there is no emitted light therefrom. Since light from the light source 22 always reaches the fourth reflector 26, a luminous intensity distribution D6 is formed below the horizontal line H (refer to FIG. 21). Accordingly, downward light is added to the luminous intensity distribution Ds for passing-by entirely and visibility to short distance which is the target of the luminous intensity distribution Ds for passing-by may further be improved.

Figure 22:
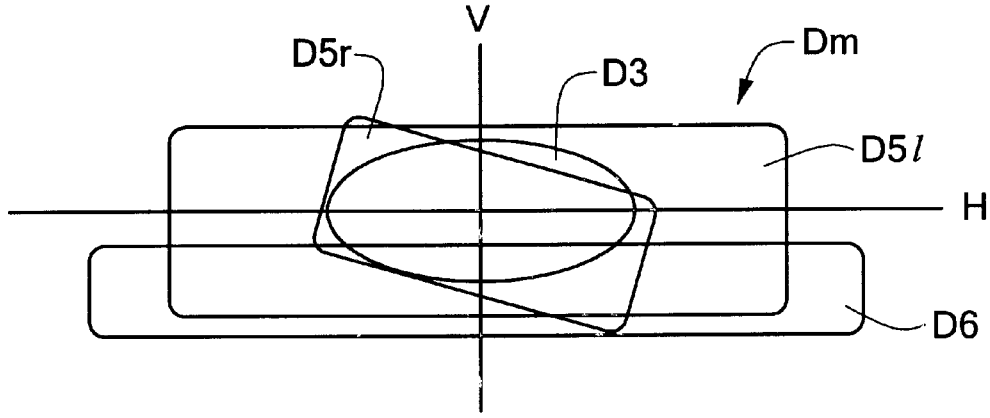
FIG. 22 is an explanatory view showing a luminous intensity distribution for running of the same headlamp for a vehicle as that in FIG. 21.

FIG. 22 shows a luminous intensity distribution Dm for running of the headlamp 21 according to the present invention. Since the first mirrors 28R, 28L are moved from the vicinity of the second focal points f42R, f42L of the second reflectors 24R, 24L to downward positions, respectively, shielding of upward light is cancelled. Further, the luminous intensity distributions D5r, D51 formed by the pair of third reflectors 25R, 25L change their shapes to widen their widths upward.

At the same time, the third mirrors 30 are moved downward so that the light from the light source 22 also reaches the first reflector 23. As a result, the first reflector 23 forms the luminous intensity distribution D3 for illuminating in a front direction (in the vicinity of intersection of the horizontal line H and the vertical line V). Accordingly, the entire luminous intensity distribution Dm for running for mainly illuminating in the forward direction can be formed by the light from the first reflector 23 and the third reflectors 25R, 25L. Therefore, the luminous intensity distribution Dm for running become suitable for the demand of visibility to long distance. Since main purpose of the third mirrors 30 is to shield the first mirror 23 when switching the luminous intensity distributions, mirror finishing therefor may be omitted.

In the headlamp 21 of the present invention, the first reflector 23 employs a reflector cut at its upper and lower portions, and light reaching the cut portions is utilized by the second reflectors 24R, 24L and the fourth reflector 26. Accordingly, a thinner headlamp can be obtained while lowering of luminous flux efficiency relative to the light source 22 can be prevented, and an original designed headlamp 21 can be presented.

The basic shape of the luminous intensity distribution Ds for passing-by is formed by the second reflectors 24R, 24L and the third reflectors 25R, 25L and the first reflector 23 does not contribute its formation. Conventionally, in order to form a precise shape of the luminous intensity distribution Ds for passing-by, it is necessary to provide a shielding means such as a hood which is provided in a bulb in case of employing of a halogen lamp as the light source 22, and a shielding stripe which is provided on an outer surface of a bulb in case of employing of a metal halide discharge lamp. The present invention can improve the luminous flux efficiency of the light bulb 22 without these means.

Further, since the first reflector 23 is covered with the third mirrors 30 in case of forming of the luminous intensity distribution Ds, it is considered that luminous flux corresponding this area would be lost. However, by providing the third mirrors 30 inclined to shorten the distance between the upper ends thereof and widen the distance between the lower ends thereof, light which has been shielded during shielding of the first reflector 23 can be supplied to the fourth reflector 26, thereby preventing the loss of light.

Figure 23:
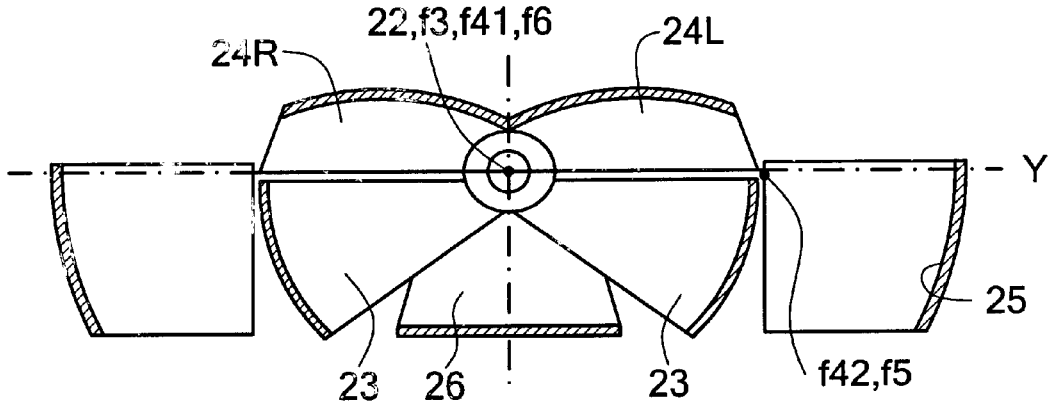
FIG. 23 is an explanatory view showing still another embodiment of the present invention.

FIG. 23 shows still another embodiment of the headlamp 21 according to the present invention. If the headlamp 21 for a vehicle is a dedicated lamp, for example, for running or for fog-lamp which does not change its luminous intensity distribution, the first mirrors 28R, 28L, the second mirrors 29R, 29L, and the third mirrors 30 do not need to be movable. In addition, in the above case since there is no need to form a border between light and shade, such headlamps do not need these mirrors. Accordingly, in this case, as shown in FIG. 23 the respective mirrors 28, 29, 30 can be omitted.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A headlamp for a vehicle, comprising:

a light source;

a first reflector formed of a parabolic reflector and having a focal point at which the light source is positioned;

a light guide passage for guiding light to the backside of the first reflector, provided at predetermined positions on the right and left sides of the first reflector;

a second reflector formed of parabolic reflectors and provided outside of the first reflector corresponding to the light guide passage on the right and left sides thereof;

a third reflector provided substantially on an optical axis of the first reflector for converging and transmitting a light from the light source to the light guide passage; and a lens provided in front of the first and second reflectors in an illuminating direction.

2. The headlamp for a vehicle according to claim 1, wherein a focal point of said second reflector is set in said light guide passage.

3. The headlamp for a vehicle according to claim 1, wherein said third reflector is an elliptic type reflector having a first focal point at which said light source is arranged and a second focal point at which an inlet of said light guide passage is positioned.

4. The headlamp for a vehicle according to claim 1, wherein the third reflector serves as a hood for said light source.

5. The headlamp for a vehicle according to claim 1, wherein an optical axis of the second reflector is substantially parallel to the optical axis of the first reflector on at least one cross section in either a horizontal direction or a vertical direction.

6. The headlamp for a vehicle according to claim 1, wherein the optical axis of the second reflector is set to be substantially 2° downward relative to the optical axis of the first reflector.

7. The headlamp for a vehicle according to claim 1, wherein the light guide passage is provided above a horizontal line which passes through the light source and which is perpendicular to the optical axis and at a range of ±45° around the light source as the origin in forward and backward directions relative to a horizontal illuminating line of the headlamp for a vehicle.

8. The headlamp for a vehicle according to claim 1, wherein the light guide passage has an inlet and an outlet which are spaced at predetermined distances, and is tubular.

9. The headlamp for a vehicle according to claim 1, wherein at least a part of the outlet of the light guide passage contains a plane perpendicular to a straight line which is perpendicular to the optical axis of said second reflector.

10. The headlamp for a vehicle according to claim 1, wherein a shape of an outlet of the light guide passage is adjusted to be suitable to form a luminous intensity distribution property required for the second reflector.

11. The headlamp for a vehicle according to claim 1, wherein an upper end of the light guide passage coincides with at least one of an upper end of the first reflector and an upper end of the second reflector.

12. The headlamp for a vehicle according to claim 1, wherein an upper end of a predetermined area of the lens coincides with or is set lower than a lower end of the light guide passage.

13. The headlamp for a vehicle according to claim 1, wherein a top of the first reflector is formed of convex protruding inside of the first reflector to reflect upward light reflected from the first reflector as a horizontal light or downward light.

14. The headlamp for a vehicle according to claim 1, wherein the inside of the light guide passage is treated by reflection treatment.

15. The headlamp for a vehicle according to claim 1, wherein the inside of the light guide passage is filled with a light guide material.

16. The headlamp for a vehicle according to claim 1, wherein the first reflector is a parabolic free curved surface and the third reflector has a width at the front side of the light source wider than that at the back side of the light source.

17. A headlamp for a vehicle, comprising:

a light source;

a first reflector formed of a parabolic reflector which is cut at upper and lower portions thereof and having a focal point at which the light source is positioned, an optical axis thereof being directed to an illuminating direction;

a pair of second reflectors formed of an elliptic type reflector provided above the first reflector so as that the major axis thereof is perpendicular to the optical axis in a horizontal direction, and having a first focal point at which the light source is positioned;

a pair of third reflectors each formed of a parabolic reflector having a focal point at which a second focal point of each of the second reflectors is positioned, and provided at both outsides of the first reflector; and a fourth reflector formed of a parabolic reflector having a focal point at which the light source is positioned, an optical axis thereof being directed to the illuminating direction, and provided below the first reflector and said light source.

18. The headlamp for a vehicle according to claim 17, wherein said headlamp is further provided with a pair of first mirrors having reflecting surfaces directing upward along major axes of the second reflectors, respectively and provided in such a manner that tip ends thereof coincide with the second focal points of the second reflectors, respectively, and a pair of third mirrors each having reflecting surfaces directing to sides of the light source and provided at both sides of the light source, wherein one of the pair of first mirrors or the pair of third mirrors is movable in a vertical direction to change luminous intensity distribution.

19. The headlamp for a vehicle according to claim 18, wherein the tip ends of the pair of first mirrors is asymmetric in an angle intersecting with the major axis of the second reflector.

20. The headlamp for a vehicle according to claim 18, wherein the tip ends of the pair of first mirrors are perpendicular to the major axis, and the pair of first mirrors is tilted at a predetermined angle relative to the major axis as a rotation axis.

21. The headlamp for a vehicle according to claim 18, wherein a border between light and shade of the luminous intensity distribution for passing-by is formed by the tip ends of the pair of first mirrors.

22. The headlamp for a vehicle according to claim 21, wherein one of the tip ends of the pair of first mirrors forms an elbow portion of the border between light and shade in the luminous intensity distribution for passing-by, and the other of the tip ends of the pair of first mirrors forms a horizontal portion of the border between light and shade in the luminous intensity distribution for passing-by.

23. The headlamp for a vehicle according to claim 18, wherein a second mirror is provided so as to direct a reflecting surface thereof to the pair of first mirrors.

24. The headlamp for a vehicle according to claim 23, wherein the second mirror is provided so as to receive a reflected light from the pair of first mirrors.

25. The headlamp for a vehicle according to claim 23, wherein the pair of first mirrors and the second mirror are formed integrally.

26. The headlamp for a vehicle according to claim 18, wherein both the pair of first and third mirrors are moved together in either an upper direction or a lower direction to change the luminous intensity distribution.

27. The headlamp for a vehicle according to claim 26, wherein movement of the pair of first mirrors is not carried out simultaneously with movement of the pair of third mirrors.

28. The headlamp for a vehicle according to claim 18, wherein the pair of third mirrors are inclined to shorten a distance between upper ends thereof and to widen a distance between lower ends thereof.

29. The headlamp for a vehicle according to claim 18, wherein the pair of third mirrors do not have a reflecting function.

30. The headlamp for a vehicle according to claim 18, wherein at least one of the pair of first mirrors, the second mirror, and the pair of third mirrors is formed of a curved surface.

31. The headlamp for a vehicle according to claim 18, wherein either the pair of first mirrors or the pair of third mirrors is formed of a free curved surface.

32. The headlamp for a vehicle according to claim 2, wherein:

said third reflector is an elliptic type reflector having a first focal point at which said light source is arranged and a second focal point is positioned in an inlet of said light guide passage;

the third reflector serves as a hood for said light source;

an optical axis of the second reflector is substantially parallel to the optical axis of the first reflector on at least one cross section in either a horizontal direction or a vertical direction;

the optical axis of the second reflector is set to be substantially 2° downward relative to the optical axis of the first reflector;

the light guide passage is provided above a horizontal line which passes through the light source and which is perpendicular to the optical axis and at a range of ±45° around the light source as the origin in forward and backward directions relative to a horizontal illuminating line of the headlamp for a vehicle;

the light guide passage has an inlet and an outlet which are spaced at a predetermined distance, and is tubular;

at least a part of the outlet of the light guide passage contains a plane perpendicular to a straight line which is perpendicular to the optical axis of said second reflector;

a shape of an outlet of the light guide passage is adjusted to be suitable to form a luminous intensity distribution property required for the second reflector;

an upper end of the light guide passage coincides with at least one of an upper end of the first reflector and an upper end of the second reflector;

an upper end of a predetermined area of the lens coincides with or is set lower than a lower end of the light guide passage;

a top of the first reflector is formed of convex protruding inside of the first reflector to reflect upward light reflected from the first reflector as a horizontal light or a downward light;

the inside of the light guide passage is treated by a reflection treatment;

the inside of the light guide passage is filled with a light guide material; and the first reflector is a parabolic free curved surface and the third reflector has a width at the front side of the light source wider than that at the back side of the light source.

33. The headlamp for a vehicle according to claim 19, wherein:

a border between light and shade of the luminous intensity distribution for passing-by is formed by the tip ends of the pair of first mirrors;

one of the tip ends of the pair of first mirrors forms an elbow portion of the border between light and shade in the luminous intensity distribution for passing-by, and the other of the tip ends of the pair of first mirrors forms a horizontal portion of the border between light and shade in the luminous intensity distribution for passing-by;

a second mirror is provided so as to direct a reflecting surface thereof to the pair of first mirrors;

the second mirror is provided so as to receive a reflected light from the pair of first mirrors;

the pair of first mirrors and the second mirror are formed integrally;

both the pair of first and third mirrors are moved together in either an upper direction or a lower direction to change the luminous intensity distribution;

movement of the pair of first mirrors is not carried out simultaneously with movement of the pair of third mirrors;

the pair of third mirrors are inclined to shorten a distance between upper ends thereof and to widen a distance between lower ends thereof;

the pair of third mirrors do not have a reflecting function;

at least one of the pair of first mirrors, the second mirror and the pair of third mirrors is formed of a curved surface; and either the pair of first mirrors or third mirror is formed of a free curved surface.

34. The headlamp for a vehicle according to claim 20, wherein:

a border between light and shade of the luminous intensity distribution for passing-by is formed by the tip ends of the pair of first mirrors;

one of the tip ends of the pair of first mirrors forms an elbow portion of the border between light and shade in the luminous intensity distribution for passing-by, and the other of the tip ends of the pair of first mirrors forms a horizontal portion of the border between light and shade in the luminous intensity distribution for passing-by;

a second mirror is provided so as to direct a reflecting surface thereof to the pair of first mirrors;

the second mirror is provided so as to receive a reflected light from the pair of first mirrors;

the pair of first mirrors and the second mirror are formed integrally;

both the pair of first and third mirrors are moved together in either an upper direction or a lower direction to change the luminous intensity distribution;

movement of the pair of first mirrors is not carried out simultaneously with movement of the pair of third mirrors;

the pair of third mirrors are inclined to shorten a distance between upper ends thereof and to widen a distance between lower ends thereof;

the pair of third mirrors do not have a reflecting function;

at least one of the pair of first mirrors, the second mirror and the pair of third mirrors is formed of a curved surface; and either the pair of first mirrors or the pair of third mirrors is formed of a free curved surface.

* * * * *

UNITED STATES PATENT AND TRADEMARK OFFICE

CERTIFICATE OF CORRECTION

PATENT NO. : 6,471,383 B1
DATED : October 29, 2002
INVENTOR(S) : Hiroo Oyama et al.

It is certified that error appears in the above-identified patent and that said Letters Patent is hereby corrected as shown below:

Title page,
Item [57], ABSTRACT,
Line 8, delete “It”;

Column 4,
Line 27, “arid” should read -- and --;

Column 5,
Line 43, “arid” should read -- and --;

Coumn 6,
Line 52, “hiorizontal” should read -- horizontal --;
Lines 52 and 53, “arid” should read -- and --;

Column 7,
Line 16, “Lo” should read -- to --;
Line 17, “front” should read -- from --;

Column 8,
Line 39, “and can” should read -- and 5 can --;

Column 10,
Line 43, “ind” should read -- end --;

Column 12,
Line 66, delete “20”;

Column 13,
Line 60, “281” should read -- 28L --;
Line 64, “β” should read -- Y --;
Line 65, “f” should read -- β --;

Column 14,
Line 41, “28P” should read -- 28R --;
Line 65, “Si” should read -- S1 --;
Line 65, “52” should read -- S2 --;

UNITED STATES PATENT AND TRADEMARK OFFICE

CERTIFICATE OF CORRECTION

PATENT NO. : 6,471,383 B1
DATED : October 29, 2002
INVENTOR(S) : Hiroo Oyama et al.

It is certified that error appears in the above-identified patent and that said Letters Patent is hereby corrected as shown below:

Column 15,
Lines 1-2, delete "source 22 reaches the first reflector 23. --; and
Line 7, "first mirrors" should read -- first reflector 23 from the light source 22. When the first mirrors --.

Signed and Sealed this

Twenty-fourth Day of February, 2004

JON W. DUDAS
*Acting Director of the United States Patent and Trademark Office*